United States Patent [19]

Dussourd

[11] Patent Number: 4,832,565

[45] Date of Patent: May 23, 1989

[54] CENTRIFUGAL PUMP

[75] Inventor: Jules L. Dussourd, Princeton, N.J.

[73] Assignee: Sunstrand Corporation, Rockford, Ill.

[21] Appl. No.: 171,025

[22] Filed: Mar. 21, 1988

[51] Int. Cl.[4] ..... F01D 25/16

[52] U.S. Cl. ..... 415/110; 384/901

[58] Field of Search ..... 415/110, 111, 112, 113; 384/123, 121, 901, 110

[56] References Cited

U.S. PATENT DOCUMENTS

| | | | |
|---|---|---|---|
| 641,624 | 1/1900 | Clarke et al. | 415/113 |
| 1,032,828 | 7/1912 | Hayton | 415/97 |
| 1,743,916 | 1/1930 | Hargis | 415/128 |
| 1,768,313 | 6/1930 | Ferguson et al. | 415/128 |
| 3,180,568 | 4/1965 | Oettle | 415/112 |
| 3,245,656 | 4/1966 | Desbaillets et al. | 415/112 |
| 3,447,782 | 6/1969 | Sproule | 415/112 |
| 3,612,713 | 10/1971 | Eggins et al. | 415/110 |
| 3,868,196 | 2/1975 | Lown | 415/146 |
| 4,083,647 | 4/1978 | Tatkov et al. | 415/113 |
| 4,419,046 | 12/1983 | Carlini | 415/127 |

FOREIGN PATENT DOCUMENTS

| | | | |
|---|---|---|---|
| 110553 | 8/1925 | Switzerland | 415/110 |

*Primary Examiner*—Robert E. Garrett
*Assistant Examiner*—John T. Kwon
*Attorney, Agent, or Firm*—Wood, Dalton, Phllips, Mason & Rowe

[57] ABSTRACT

A centrifugal pump includes a rotating impeller for accelerating low pressure inlet fluid to a substantially tangential high pressure fluid. A pair of floating rotatable shrouds flank opposite axial sides of the rotating impeller. Pressurized hydrostatic bearings back the shrouds to float and support the shrouds in a uniform fashion. Pressurization for the hydrostatic bearings can come from the high pressure fluid side of the pump.

16 Claims, 1 Drawing Sheet

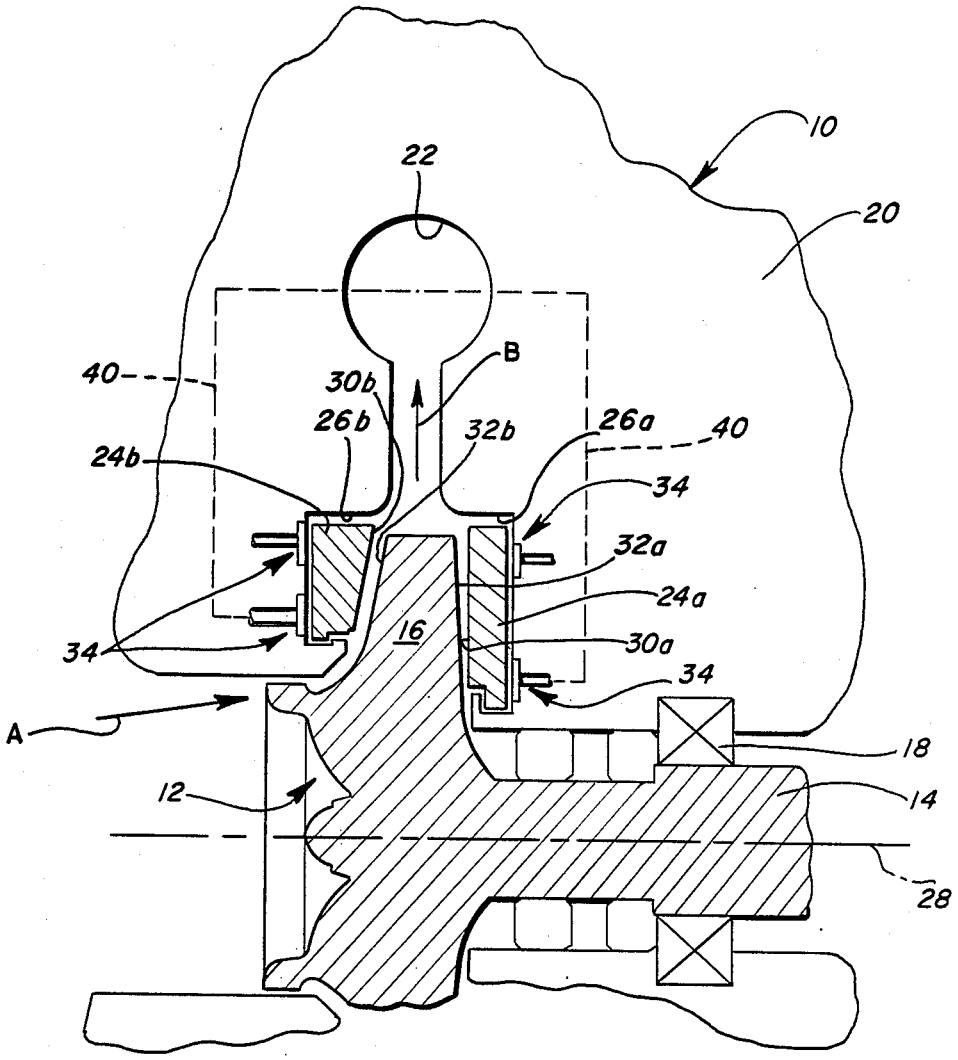
10
22
20
40
B
30b
26b
32b
26a
40
24b
34
32a
24a
16
30a
34
34
A
18
12
14
28

CENTRIFUGAL PUMP

FIELD OF THE INVENTION

This invention generally relates to centrifugal pumps and, particularly, to a system for improving the efficiency of centrifugal pumps such as radial discharge impeller pumps.

BACKGROUND OF THE INVENTION

The efficiency of centrifugal pumps, such as radial discharge centrifugal impeller pumps, is inhibited by what is called parasitic frictional drag on the pump impeller. This invention is directed to a new system for decreasing the parasitic frictional horsepower in centrifugal pumps of the closed or open impeller type. For pumps of low efficiency, this parasitic loss may amount to as much as 30% to 40% of the maximum power. Reduction of this power loss is beneficial over the entire flow range of the pump, including shut-off.

Attempts have been made to use rotating side walls for such pumps, with the side walls mounted on mechanical bearings concentric to the pump's center line. Such a rotating wall must be made structurally massive to support the pressure differentials between the front and back of the rotating walls. Furthermore, such a rotating wall must carry the net thrust, and a thrust bearing must be provided in both directions.

This invention is directed to a new and improved pump of the character described which employs floating, rotatable shrouds to reduce parasitic frictional drag as well as to allow the shrouds to be configured with lesser mass than might be required in order to support the pressure differential across the shrouds.

SUMMARY OF THE INVENTION

An object, therefore, of the invention is to provide a new and improved, more efficient centrifugal pump for decreasing the parasitic frictional horsepower of the pump.

In the exemplary embodiment of the invention, a centrifugal pump is illustrated with impeller means mounted in a housing for accelerating low pressure inlet fluid to a substantially tangential high pressure fluid at a discharge point radially outwardly of the impeller means. The impeller means may include open impeller blades, and a pair of floating, rotating shrouds flank opposite axial sides of the impeller blades. Fluid existing between the impeller blades and the axially inward surfaces of the floating shrouds produces a viscous force between the impeller blades and the shrouds which tends to cause the shrouds to rotate under shear forces between the impeller and the shrouds. Normally, the shrouds would rotate at a lesser speed than the impeller due to these forces.

Pressurized hydrostatic bearing means are provided, backing the shroud to float and support the shrouds in a uniform fashion. In other words, a hydrostatic bearing support is formed for each shroud which is uniformly distributed and, consequently, capable of reducing, because of absence of bending loads, the thickness and massiveness of the designs found in the prior art.

As illustrated, the shrouds are ring-like in configuration, are centered in complementary recesses in the stationary housing concentric with the axis of rotation of the impeller means, and have surfaces facing respective sides of the impeller means that generally conform to the shape of the impeller blades. The hydrostatic bearing means reduce the friction between the floating shrouds and the stationary components thereabout.

Although pressurization for the hydrostatic bearing means can be provided from any beneficial source, it would be desirable to pressurize the bearings with fluid from downstream of the diffuser of the pump where high pressure is readily available. In other words, the hydrostatic bearing means would be pressurized from the high pressure fluid at the discharge of the pump.

Other objects, features and advantages of the invention will be apparent from the following detailed description taken in connection with the accompanying drawings.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing, wherein the single FIGURE is a somewhat schematic, generally axial section through a centrifugal, impeller-type pump embodying the concepts of the invention.

DETAILED DESCRIPTION OF THE PREFERRED EMBODIMENT

Referring to the drawing in greater detail, the invention is illustrated herein as embodied in a centrigual pump, generally designated 10, which includes rotating impeller means, generally designated 12. The impeller means is mounted on a rotating shaft 14 and includes radially outwardly projecting impeller blades 16. The shaft is journaled on appropriate bearings 18. The impeller means is mounted for rotation on the shaft within an appropriate casing or housing 20 which also defines a surrounding scroll 22.

Centrifugal pump 10 is shown somewhat schematic in the FIGURE since the aforedescribed components of the pump are generally conventional. Suffice it so say, rotating impeller means 12, including impeller blades 16, accelerate low pressure inlet fluid, such as indicated by arrow "A", to a substantially high pressure fluid, as at arrow "B", into scroll 22 which conventionally includes an outlet at the discharge side of the pump.

The invention contemplates at least one, but preferably a pair of floating, rotating shrouds **24*a* and 24*b* flanking opposite axial sides of the rotating impeller means, at the impeller blade areas thereof. Each floating shroud 24*a* and 24*b* is disposed in a complementarily shaped recess 26*a* and 26*b*, respectively, in housing 20. Each shroud is generally ring-like in configuration and, along with its respective recess, is concentric with the axis of rotation 28 of the impeller means. In addition, the axially inwardly facing sides or surfaces 30*a* and 30*b* of the shrouds preferably generally conform to the facing respective sides 32*a* and 32*b* of the impeller. In the schematic illustration for instance, it can be seen that side 30*b* of shroud 24*b* is at a greater angle to conform to the angle of side 32*b*** of the impeller than is shown on the opposite axial side of the impeller.

The invention contemplates backing floating shrouds **24*a*, 24*b* with hyrostatic bearings, generally designated 34. The hydrostatic bearings are pressurized with fluid and, in essence, allow the viscous force between the impeller blades and the floating shrouds to cause the shrouds to rotate. The hydrostatic bearings reduce the friction between the floating shrouds and the surrounding stationary components, such as the surrounding walls of recesses 26***a*, 26*b* of housing 20. Because the shrouds can rotate, the viscosity gradients between the impeller and the shrouds are reduced, thus decreasing the drag imposed upon the impeller. Although ample spacing is shown in the drawing to facilitate the illustration, the bearing clearances preferably should be relatively small. In operation, shear forces between the impeller blades and the shrouds cause the shrouds to rotate, although at a lesser speed than the impeller. In practice, the shrouds normally would rotate at approximately one-half of the speed of the impeller blades.

Although pressure for hydrostatic bearings 34 can be obtained from any appropriate source, fluid can be obtained under high pressure downstream of the diffuser of the pump. In other words, the hydrostatic bearing means are pressurized from the high pressure fluid of the pump, as shown by the phantom lines 40 which may represent appropriate conduit means between the high pressure side of the pump and the hydrostatic bearings. Therefore, a completely self-contained system is afforded.

In operation, as the pump is started, the rotatable shrouds may well be inoperative because they are not "floated" and may remain passive until the pressure of the pump is sufficiently high to produce "lift-off" and rotation of the individual shrouds. In practice, hydrostatic bearings are stiff so that very small motion of the moving parts will result in appreciable changes in the supporting pressure. Consequently, the floating process is achieved with relatively minor axial movements of the floating surfaces. Benefits are achieved, however, since the speed of rotation of the shrouds is determined by the relative shear stresses on the opposed faces of the shrouds. Because the bearing clearance will generally be small, it can be expected that the higher shear drag of a bearing face will limit the speed of rotation of the shroud.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A centrifugal pump, comprising:

rotating impeller means for accelerating low pressure inlet fluid to a substantially tangential high pressure fluid;

a floating rotatable shroud flanking an axial side of the rotating impeller means; and pressurized hydrostatic bearing means backing the shroud to float and support the shroud in a uniform fashion.

2. A centrifugal pump as described in claim 1 wherein said shroud is disposed in a complementary recess in a stationary housing which is disposed about the impeller means.

3. A centrifugal pump as described in claim 1 wherein an axial side of said shroud facing the impeller means is shaped to conform to the axial side of the impeller means.

4. A centrifugal pump as described in claim 1 wherein said shroud is ring-like in configuration.

5. A centrifugal pump as described in claim 4 wherein said shroud is concentric with the axis of rotation of the impeller means.

6. A centrifugal pump as described in claim 1, including means for pressurizing said hydrostatic bearing means from the high pressure fluid of the pump.

7. A centrifugal pump as described in claim 1, including a pair of said floating rotatable shrouds flanking opposite axial sides of the rotating impeller means.

8. A centrifugal pump, comprising:

rotating impeller means for accelerating low pressure inlet fluid to a substantially tangential high pressure fluid;

a pair of floating rotatable shrouds flanking opposite axial sides of the rotating impeller means, with axially inwardly facing sides of the shrouds being shaped to conform to the respective adjacent axial sides of the impeller means; and pressurized hydrostatic bearing means backing each shroud to float and support the shrouds in a uniform fashion.

9. A centrifugal pump as described in claim 8 wherein said shrouds are disposed in complementary recesses in a stationary housing which is disposed about the impeller means.

10. A centrifugal pump as described in claim 8 wherein said shrouds are ring-like in configuration.

11. A centrifugal pump as described in claim 10 wherein each shroud is concentric with the axis of rotation of the impeller means.

12. A centrifugal pump as described in claim 8, including means for pressurizing said hydrostatic bearing means from the high pressure fluid of the pump.

13. A centrifugal pump, comprising:

stationary housing means;

rotating impeller means in said housing means for accelerating low pressure inlet fluid to a substantially tangential high pressure fluid;

a ring-like floating rotatable shroud concentric with the axis of rotation of the impeller means and flanking an axial side of the impeller means, the shroud being disposed in a complementary recess in the stationary housing means which is disposed about the impeller means;

pressurized hydrostatic bearing means backing the shroud to float and support the shroud in a uniform fashion.

14. A centrifgual pump as described in claim 13 wherein an axial side of said shroud facing the impeller means is shaped to conform to the axial side of the impeller means.

15. A centrifugal pump as described in claim 13, including means for pressurizing said hydrostatic bearing means from the high pressure fluid of the pump.

16. A centrifugal pump as described in claim 13, including a pair of said floating rotatable shrouds flanking opposite axial sides of the rotating impeller means.

* * * * *